US005977354A

United States Patent [19]

Spencer et al.

[11] Patent Number: 5,977,354

[45] Date of Patent: Nov. 2, 1999

[54] RECOVERY OF SECONDARY EXPLOSIVES FROM EXPLOSIVE COMPOSITIONS

[75] Inventors: Arthur F. Spencer, Niceville; David F. Hartline, Destin, both of Fla.

[73] Assignee: The United States of America as represented by the Secretary of the Air Force, Washington, D.C.

[21] Appl. No.: 09/211,491

[22] Filed: Dec. 15, 1998

[51] Int. Cl.[6] ..... C07D 257/02; C07D 251/24

[52] U.S. Cl. ..... 540/475; 585/833; 544/180

[58] Field of Search ..... 540/475; 588/149; 544/180

[56] References Cited

U.S. PATENT DOCUMENTS

| | | | |
|---|---|---|---|
| 2,900,381 | 8/1959 | Thatcher et al. | 260/239 |
| 3,069,477 | 12/1962 | Lee et al. | 260/644 |
| 4,389,265 | 6/1983 | Tompa et al. | 149/109.6 |
| 5,523,517 | 6/1996 | Cannizzo et al. | 588/203 |
| 5,538,530 | 7/1996 | Heaton et al. | 149/124 |

OTHER PUBLICATIONS

Merck Index, Tenth Edition, p. 1390.

*Primary Examiner*—Mukund J. Shah
*Assistant Examiner*—Pavanaram K Sripada
*Attorney, Agent, or Firm*—Charles E Bricker; Thomas L. Kundert

[57] ABSTRACT

Secondary explosive materials, particularly nitramines, are recovered from an explosive composition containing a mixture of 2,4,6-trinitrotoluene (TNT) and at least one secondary explosive by the steps of heating the explosive composition to melt the TNT, preferably using steam, separately collecting and recovering the melted TNT, treating the thus-separated secondary explosive with a material which is a solvent for TNT and a non-solvent for the secondary explosive to dissolve the TNT, removing the non-solvent from the secondary explosive, and recovering the secondary explosive.

4 Claims, 1 Drawing Sheet

RECOVERY OF SECONDARY EXPLOSIVES FROM EXPLOSIVE COMPOSITIONS

RIGHTS OF THE GOVERNMENT

The invention described herein may be manufactured and used by or for the Government of the United States for all governmental purposes without the payment of any royalty.

BACKGROUND OF THE INVENTION

The present invention relates to the recovery of nitramines from explosive compositions.

In the past, surplus or obsolete military munitions have been disposed of by dumping them in the ocean, burning them in an open area, or detonating them in a safe zone. From an ecological standpoint, these methods are undesirable because they contribute to contamination of the ocean or pollution of the atmosphere. From an economic standpoint, the previous methods of disposal are unsatisfactory because of the utter waste of valuable explosive materials.

A need exists for an ecologically sound alternative method for disposing of unwanted munitions materials.

Accordingly, it is an object of the present invention to provide a method for the recovery of explosive materials from explosive compositions.

Other objects, aspects and advantages of the present invention will be apparent to those skilled in the art from a reading of the following detailed disclosure of the invention.

SUMMARY OF THE INVENTION

In accordance with the present invention there is provided a method for recovering secondary explosive materials, particularly nitramines, from an explosive composition containing a mixture of 2,4,6-trinitrotoluene (TNT) and at least one secondary explosive which comprises the steps of heating the explosive composition to melt the TNT, preferably using steam, separately collecting and recovering the melted TNT, treating the thus-separated secondary explosive with a material which is a solvent for TNT and a non-solvent for the secondary explosive to dissolve the TNT, removing the non-solvent from the secondary explosive, and recovering the secondary explosive.

DETAILED DESCRIPTION OF THE INVENTION

Figure 1:
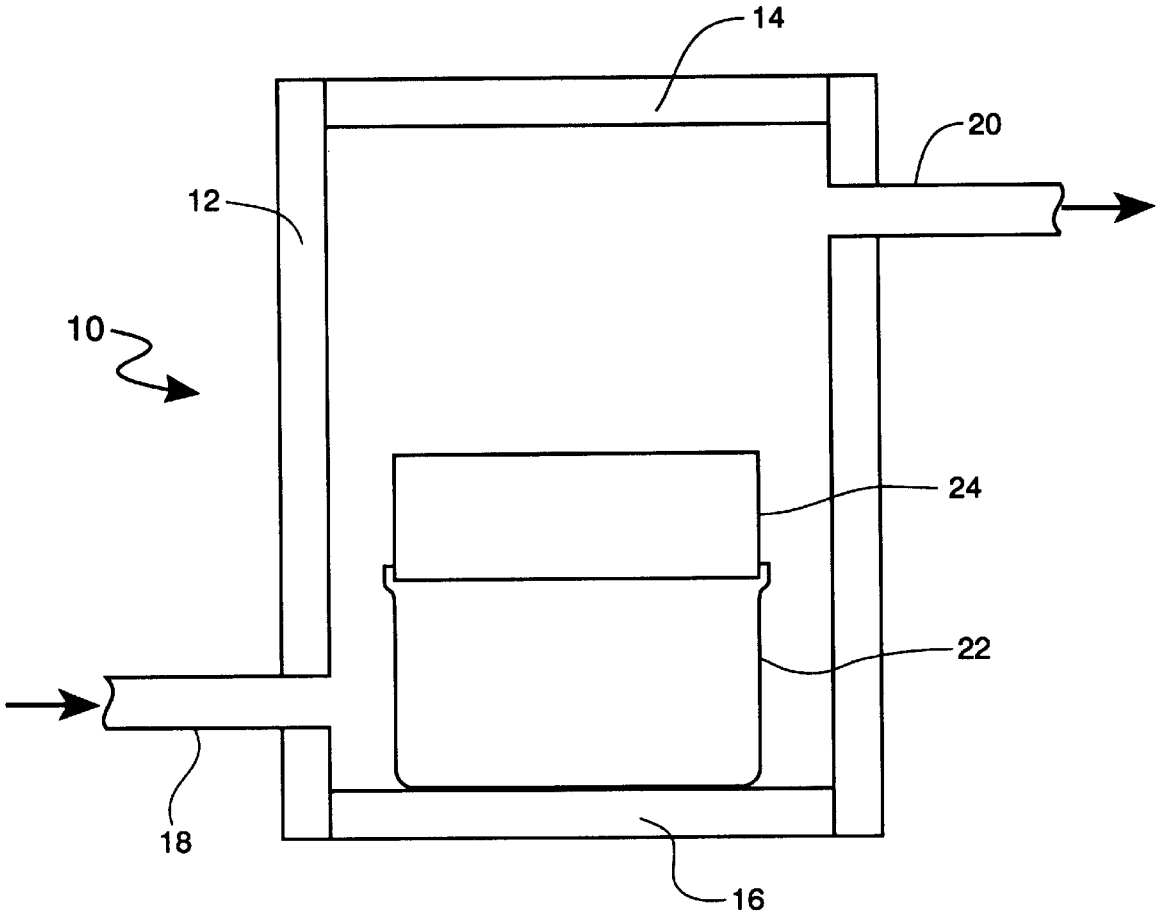
FIG. 1 illustrates a simple apparatus for separating TNT from an explosive composition.

The method of the present invention may be used to recover secondary explosives, particularly nitramines, e.g., cyclo-1,3,5-trimethylene-2,4,6-trinitramine (RDX), cyclo-1,3,5,7-tetramethylene-2,4,6,8-tetranitramine (HMX), nitroguanidine, ethylene dinitramine, 2,4,6-trinitrophenylmethylnitramine, or mixtures thereof, preferably RDX or HMX, from mixtures with trinitrotoluene. The method may also be used to recover pentaerythritol tetranitrate (PETN) from mixtures with trinitrotoluene.

Typical military munitions include, for example: Composition B (TNT+RDX+wax); Cyclotol (TNT+RDX); HBX-3 (TNT+RDX+Al+wax); Octol (TNT+HMX); and Pentolite (TNT+PETN). 5

Referring to FIG. 1, the initial separation apparatus 10 comprises a housing 12 having a removable top closure 14, a bottom closure 16, steam inlet 18 and a steam outlet 20. Apparatus 10 further comprises a collector vessel 22 and a sieve tray 24. In use, an explosive composition removed from a munition is placed in sieve tray 24, which in turn is placed over collector vessel 22 within housing 12. The top closure 14 is installed, then steam is introduced through inlet 18. Steam is admitted into housing 12, as necessary, to maintain the temperature within housing 12 above the melting temperature of TNT (84° C.) and below the initial decomposition temperature of the secondary explosive in the explosive composition. It is presently preferred to maintain this temperature at about 90° C.

The TNT which melts out of the explosive composition flows through the sieve in tray 24 and into collector vessel 22. Heating is continued for as long as necessary to melt out a substantial portion of the TNT. When melt-out is complete, the secondary explosive crystals in the sieve tray 24 may be stirred to break up conglomerations.

The secondary explosive crystals are next washed several times with a material which is a solvent for TNT and a non-solvent for the secondary explosive. For HMX, this non-solvent is preferably acetone; for RDX this non-solvent is preferably toluene. Other non-solvents for the remaining secondary explosives can be easily determined by those skilled in the art. The secondary explosive crystals are then washed with distilled water and dried.

The following example illustrates the invention:

EXAMPLE

HMX was separated from the TNT in a sample of Octol following the procedure given above. Following the melt-out of the TNT, the HMX crystals were washed several times with acetone until the concentration of TNT was not detectable. The HMX crystals were then washed with distilled water to remove the acetone, then dried. The properties of the thus-recovered HMX are compared to the properties of virgin HMX in the following table:

TABLE

| Test | Reclaimed HMX | Virgin HMX |
|---|---|---|
| Impact (cm) | 23.1 | 21.2 |
| Friction (N) | 12 | 10.8 |
| $E_a$ (DSC) (kcal/mol) | 109.85 | 88.06 |
| $E_a$ (ARC) (kcallmol) | 110.37 | 78.696 |
| SeIf Heating (°C.) | 209.5 | 199.5 |
| Temp @ Max Rate (°C.) | 223.5 | 241.4 |

Impact sensitivity testing was conducted with a 2.5 kg weight and a type 12 tool.

Friction sensitivities were performed on a BAM friction tester.

Thermal sensitivity was determined by differential scanning calorimetry (DSC) and accelerating rate calorimetry (ARC): Variable Heating Rate Differential Scanning Calorimetry (DSC) was used to determine the Arrhenius parameters. As noted, the activation energies ($E_a$) for reclaimed and virgin HMX were 109.85 and 88.06 kcal/mol, respectively. The frequency factors of the reclaimed and virgin HMX were $5.93\times10^{41}$ $sec^{-1}$ and $1.53\times10^{33}$ $sec^{-1}$, respectively.

Accelerating Rate Calorimetry was used to measure self heating initiation temperature, activation energy and temperature at maximum rate.

Examination of the data in the preceeding table reveals that the general trends for the ARC and DSC tests were the same. These data indicate that the thermal sensitivity of reclaimed HMX is not adversely affected.

HPLC was used to detect TNT and other impurities in the reclaimed HMX. The chromatography apparatus was equipped with a Brownela spheri-5 RP-18 5 micron column. A photodiode array was used to absorb light between 200 and 800 nm. A flow rate of 1 cc/min (water and acetonitrile 43/57) was used. The chromatogram for Octol (75/25) exhibited sharp peaks for HMX and TNT; the chromatogram for reclaimed HMX exhibited a sharp peak for HMX, but no peak for TNT.

A Scanning Electron Microscope was used to observe and compare crystals of reclaimed and virgin HMX. There were no obvious differences between the crystals.

Various modifications may be made to the invention as described without departing from the spirit of the invention or the scope of the appended claims.

We claim:

1. A method for recovering secondary explosives from an explosive composition containing a mixture of 2,4,6-trinitrotoluene and at least one secondary explosive which comprises the steps of (a) heating the explosive composition to melt the trinitrotoluene;

(b) separately collecting the melted trinitrotoluene;

(c) recovering the thus-separated secondary explosive;

(d) treating the thus-separated secondary explosive with a material which is a solvent for trinitrotoluene and a non-solvent for the said secondary explosive;

(e) removing the non-solvent from said secondary explosive; and (f) recovering said secondary explosive.

2. The method of claim 1 wherein said explosive composition is heated with steam to melt said trinitrotoluene.

3. The method of claim 1 wherein said secondary explosive is cyclo-1,3,5,7-tetramethylene-2,4,6,8-tetranitramine (HMX) and said non-solvent is acetone.

4. The method of claim 1 wherein said secondary explosive is cyclo-1,3,5-trimethylene-2,4,6-trinitramine (RDX) and said non-solvent is toluene.

* * * * *